US010635041B2

(12) United States Patent
Nimura et al.

(10) Patent No.: US 10,635,041 B2
(45) Date of Patent: Apr. 28, 2020

(54) CLEANING BLADE

(71) Applicant: Sumitomo Riko Company Limited, Aichi (JP)

(72) Inventors: Yasunori Nimura, Aichi (JP); Kadai Takeyama, Aichi (JP); Toshihiko Arata, Aichi (JP); Shimpei Miyagawa, Aichi (JP); Satoshi Endo, Aichi (JP)

(73) Assignee: Sumitomo Riko Company Limited, Aichi (JP)

( * ) Notice: Subject to any disclaimer, the term of this patent is extended or adjusted under 35 U.S.C. 154(b) by 52 days.

(21) Appl. No.: 15/990,705

(22) Filed: May 28, 2018

(65) Prior Publication Data

US 2018/0275595 A1 Sep. 27, 2018

Related U.S. Application Data

(63) Continuation of application No. PCT/JP2017/012339, filed on Mar. 27, 2017.

(30) Foreign Application Priority Data

Mar. 30, 2016 (JP) ..... 2016-068622

(51) Int. Cl.
*G03G 21/00* (2006.01)

(52) U.S. Cl.
CPC ..... *G03G 21/0017* (2013.01)

(58) Field of Classification Search
CPC ..... G03G 21/0017
See application file for complete search history.

(56) References Cited

U.S. PATENT DOCUMENTS 5,438,400 A * 8/1995 Kuribayashi ..... G03G 21/0017 15/256.5
2006/0216084 A1* 9/2006 Kojima ..... G03G 21/0017 399/350

(Continued)

FOREIGN PATENT DOCUMENTS

JP 2011186308 9/2011
JP 2013076970 4/2013

(Continued)

OTHER PUBLICATIONS

"International Search Report (Form PCT/ISA/210) of PCT/JP2017/012339," dated May 9, 2017, with English translation thereof, pp. 1-4.

(Continued)

*Primary Examiner* — David M. Gray
*Assistant Examiner* — Geoffrey T Evans
(74) *Attorney, Agent, or Firm* — JCIPRNET

(57) ABSTRACT

Provided is a cleaning blade. The cleaning blade is used for removing remaining toner which remains on a surface of the target member in an electrophotographic apparatus. The cleaning blade is provided with the blade portion having the edge portion which comes into sliding contact with the target member. The edge portion includes: a substrate of the blade portion; an inner layer extending from a surface of the substrate to the inside of the substrate; and an outer layer extending from a surface of the substrate to an outer outside of the substrate. The inner layer contains at least an acrylic resin or a methacrylate resin, and has a thickness of less than 1 μm. The outer layer contains at least an acrylic resin or a methacrylate resin, and has a thickness of 0.02 μm or less.

9 Claims, 2 Drawing Sheets

(56) References Cited

U.S. PATENT DOCUMENTS

| | | | | |
|---|---|---|---|---|
| 2007/0020005 | A1* | 1/2007 | Shigezaki | G03G 21/0017 399/349 |
| 2007/0201917 | A1* | 8/2007 | Teshigawara | G03G 21/0017 399/350 |
| 2010/0080636 | A1* | 4/2010 | Fowler | G03G 21/0017 399/350 |
| 2012/0301176 | A1* | 11/2012 | Ferrar | G03G 15/161 399/101 |
| 2013/0034375 | A1* | 2/2013 | Kashiwakura | G03G 21/0017 399/350 |
| 2013/0243484 | A1 | 9/2013 | Toda et al. | |
| 2014/0193172 | A1* | 7/2014 | Tawada | G03G 21/0029 399/111 |
| 2019/0278212 | A1* | 9/2019 | Sakuda | G03G 21/0017 |

FOREIGN PATENT DOCUMENTS

| | | |
|---|---|---|
| JP | 2013190642 | 9/2013 |
| JP | 2015084078 | 4/2015 |

OTHER PUBLICATIONS

"International Preliminary Report on Patentability (Form PCT/IPEA/409) of PCT/JP2017/012339," dated Jan. 9, 2018, with English translation thereof, pp. 1-20.

* cited by examiner

CLEANING BLADE

CROSS-REFERENCE TO RELATED APPLICATIONS

This application is a continuation application of International Application number PCT/JP2017/012339, filed on Mar. 27, 2017, which claims the priority benefit of Japan Patent Application No. 2016-068622, filed on Mar. 30, 2016. The entirety of each of the above-mentioned patent applications is hereby incorporated by reference herein and made a part of this specification.

BACKGROUND

Technical Field

The disclosure relates to a cleaning blade.

Description of Related Art

In the related art, in an electrophotographic apparatus, a cleaning blade is used to clean a surface of a target member such as an image earlier, for example, a photoreceptor, and an intermediate transfer belt. The cleaning blade includes a blade portion having an edge portion that comes into sliding contact with a target member. When an edge portion of the blade portion is pressed against a surface of the target member, the remaining toner on the surface of the target member that moves on the surface is scraped off.

As such a type of cleaning blade, for example, a cleaning blade having an impregnated layer formed by impregnating a curing component such as an isocyanate into a blade portion to about several tens of μm to several hundreds of μm, and then performing curing is known. In addition, a cleaning blade in which a surface layer is formed on a surface of a blade portion is known.

Here, in Japanese Patent Application Laid-Open (JP-A) No. 2013-190642 in related Art, a cleaning blade including a tip ridge line part having a lamination structure including a substrate of an elastic blade, a mixed layer including a substrate and an acrylic and/or methacrylic resin and having a film thickness of 1.0 μm or more, and a surface layer including an acrylic and/or methacrylic resin and having a film thickness of 0.1 μm or more is disclosed.

In recent years, in electrophotographic apparatuses, in order to provide high image quality, polymerized toners having a small diameter and a high degree of sphericity have been used. Thus, the toner is likely to slip through small gaps generated between a surface of the target member and the edge portion of the blade portion. When a contact pressure on the target member from the cleaning blade is increased in order to prevent the toner from slipping through, warping of the blade portion occurs.

In addition, when the thickness of the impregnated layer in the blade portion becomes thick, the edge portion becomes too hard, and chipping of the edge portion occurs with regard to durability. When chipping occurs in the edge portion, since the toner slips through the chipped part, cleaning performance deteriorates.

In addition, a surface layer in the blade portion is effective for preventing warping of the cleaning blade. However, when the thickness of the surface layer increases, the rubber elasticity of the blade portion decreases, and shape conformability with respect to the target member deteriorates. When shape conformability with respect to the target member deteriorates, since a gap is generated between the surface of the target member and the edge portion of the blade portion, and the toner slips through the gap, cleaning performance deteriorates.

SUMMARY

The disclosure has been made in view of the above circumstances, and the disclosure provides a cleaning blade capable of preventing warping of a blade portion and deterioration in cleaning performance due to chipping of an edge portion and deterioration in shape conformability with respect to a target member.

An aspect of the disclosure is a cleaning blade used to remove the remaining toner that remains on a surface of a target member in an electrophotographic apparatus, the cleaning blade including a blade portion having an edge portion that comes into sliding contact with the target member. The edge portion includes a substrate of the blade portion, an inner layer that extends from a surface of the substrate to an inside of the substrate, and an outer layer that extends from the surface of the substrate to an outside of the substrate. The inner layer contains at least one of an acrylic resin and a methacrylic resin and has a thickness of less than 1 μm. The outer layer contains at least one of an acrylic resin and a methacrylic resin and has a thickness of 0.02 μm or less.

DESCRIPTION OF THE EMBODIMENTS

Figure 1:
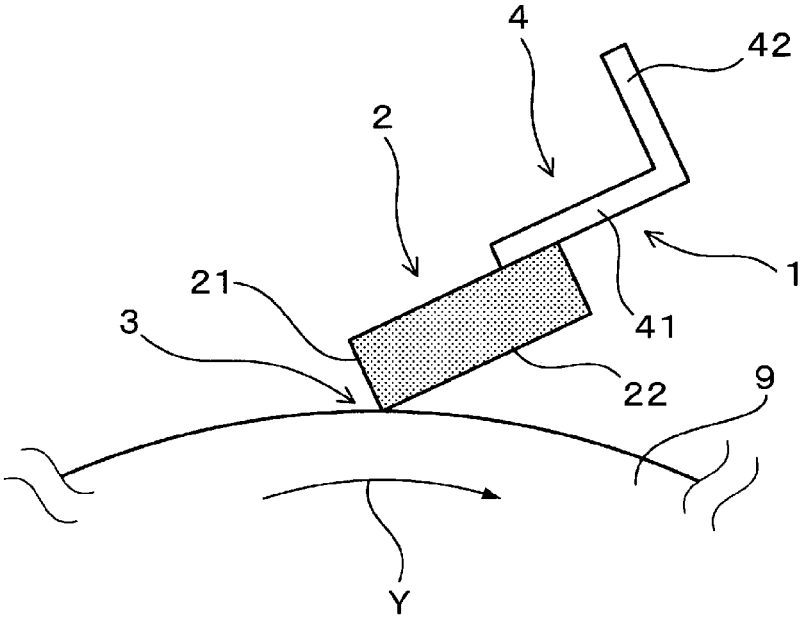
FIG. 1 is an explanatory diagram schematically showing a manner in which a cleaning blade of Example 1 is used.

A cleaning blade is used to remove the remaining toner that remains on a surface of a target member in an electrophotographic apparatus. As the electrophotographic apparatus, specifically, image forming devices such as an electrophotographic copying machine, a printer, a facsimile, a multifunctional device, and an on-demand printing machine using a charged image can be exemplified. In addition, as the target member, an image carrier such as a photosensitive drum, an intermediate transfer belt, and a charging roll can be exemplified. Here, the intermediate transfer belt is used to primarily transfer a toner image carried on an image carrier to the belt and then to secondarily transfer the toner image to a transfer material such as paper from the belt.

The cleaning blade includes a blade portion having an edge portion that comes into sliding contact with a target member. The blade portion may have, for example, a plate-like shape. Specifically, the edge portion may include a ridge line being an intersection between a first blade surface and a second blade surface adjacent to the first blade surface. More specifically, the cleaning blade can be used by bringing a ridge line of the edge portion into contact with the target member.

The edge portion includes a substrate of a blade portion, an inner layer, and an outer layer. The substrate of the blade portion can be made of a rubber elastic material. As the rubber elastic material, for example, a polyurethane rubber can be exemplified.

The inner layer extends from the surface of the substrate to the inside of the substrate. The inner layer contains at least one of an acrylic resin and a methacrylic resin, and has a thickness of less than 1 μm. Specifically, the inner layer can include a substrate of the blade portion and at least one of an acrylic resin and a methacrylic resin. Here, the acrylic resin and the methacrylic resin may be mixed with the substrate of the blade portion and may be crosslinked with a substrate of the blade portion.

When the thickness of the inner layer is 1 μm or more, the edge portion becomes too hard due to the thick inner layer, and chipping of the edge portion is likely to occur with regard to durability. Therefore, deterioration in cleaning performance is caused due to chipping of the edge portion. The thickness of the inner layer is preferably 0.8 μm or less, more preferably 0.7 μm or less, still more preferably 0.6 μm or less, and most preferably 0.5 μm or less in order to easily prevent chipping of the edge portion with regard to durability. Here, the thickness of the inner layer is preferably 0.05 μm or more in consideration of formability and durability of the inner layer.

The outer layer extends from the surface of the substrate to the outside of the substrate. The outer layer contains at least one of an acrylic resin and a methacrylic resin, and has a thickness of 0.02 μm or less. Specifically, the outer layer can be made of at least one of an acrylic resin and a methacrylic resin.

When the thickness of the outer layer is more than 0.02 μm, rubber elasticity of the blade portion is decreased due to the thick outer layer, and it is difficult to maintain shape conformability with respect to the target member. Therefore, deterioration in cleaning performance is caused due to deterioration of shape conformability with respect to the target member. Here, the thickness of the outer layer is not particularly limited, and is preferably 0.005 μm or more in consideration of formability of the outer layer and the like.

Here, the thickness of the inner layer and the thickness of the outer layer are values that are measured as follows. A dark field image (DF image) of a cross section of the blade portion is observed using a scanning transmission electron microscope (STEM). The thickness of the cross section of the inner layer is measured at positions of 10 μm, 20 μm, 30 μm, 40 μm, and 50 μm from the ridge line of the edge portion. An average value of the obtained thicknesses of the cross section of the inner layer at these measurement positions is set as a thickness of the inner layer. Similarly, the thickness of the cross section of the outer layer is measured at positions of 10 μm, 20 μm, 30 μm, 40 μm, and 50 μm from the ridge line of the edge portion. An average value of the obtained thicknesses of the cross section of the outer layer at these measurement positions is set as a thickness of the outer layer. Here, when the substrate of the blade portion is a polyurethane rubber, a cross section of the blade portion is dyed with a 10% phosphotungstic acid aqueous solution for 10 minutes, and a part which is further inside than the surface of the substrate and is hardly dyed can be defined as an inner layer. In this case, while the inner layer also contains a polyurethane rubber of the substrate, the inner layer contains an acrylic resin or a methacrylic resin. Therefore, there is a difference in dyeing between a part which is further inside than the inner layer and the inner layer.

The outer layer can have a configuration in which a plurality of particles having a particle size larger than the thickness of the outer layer are included. In this case, a plurality of protrusions due to particles on the surface of the outer layer are formed, and point contact occurs with the target member according to a plurality of protrusions. Therefore, in this case, a cleaning blade in which a dynamic friction coefficient of the edge portion decreases, and warping of the blade portion is easily prevented for a longer time is obtained. In addition, in this case, even if a contact pressure on the target member increases, a contact area between the edge portion and the target member is likely to be smaller due to protrusions according to particles. Therefore, this case is advantageous for preventing slipping through of a toner.

In consideration of prevention of damage to the target member and dispersibility in the outer layer, as a material for the particles, for example, silica, and various resins can be exemplified. As the resins, specifically, for example, an acrylic resin, a methacrylic resin, a polyurethane resin, and a polyamide resin can be exemplified. When the outer layer contains particles, particles of various materials can be used alone or two or more thereof can be used in combination.

Specifically, the particle size of the particles can be 10 nm or more and 300 nm or less. In this case, the above effects can be secured. In consideration of roughness formability, the particle size of the particles is preferably 12 nm or more, more preferably 15 nm or more, still more preferably 20 nm or more, and most preferably 25 nm or more. In addition, in consideration of cleaning performance, the particle size of the particles is preferably 280 nm or less, more preferably 250 nm or less, still more preferably 230 nm or less, and most preferably 200 nm or less.

Here, the particle size of the particles is a value that is measured as follows. A dark field image (DF image) of a cross section of the blade portion is observed using a scanning transmission electron microscope (STEM). In this case, an acceleration voltage can be 200 kV. Five arbitrary particles disposed between a position of 10 μm and a position of 50 μm from the ridge line of the edge portion are selected and the diameters of such particles are measured. An average value of the obtained diameters is set as the particle size of the particles.

Here, the above configurations can be arbitrarily combined as necessary in order to obtain the above operations and effects and the like.

EXAMPLES

Cleaning blades of examples will be described below with reference to the drawings. Here, the same members will be described using the same reference numerals.

Example 1

Figure 2:
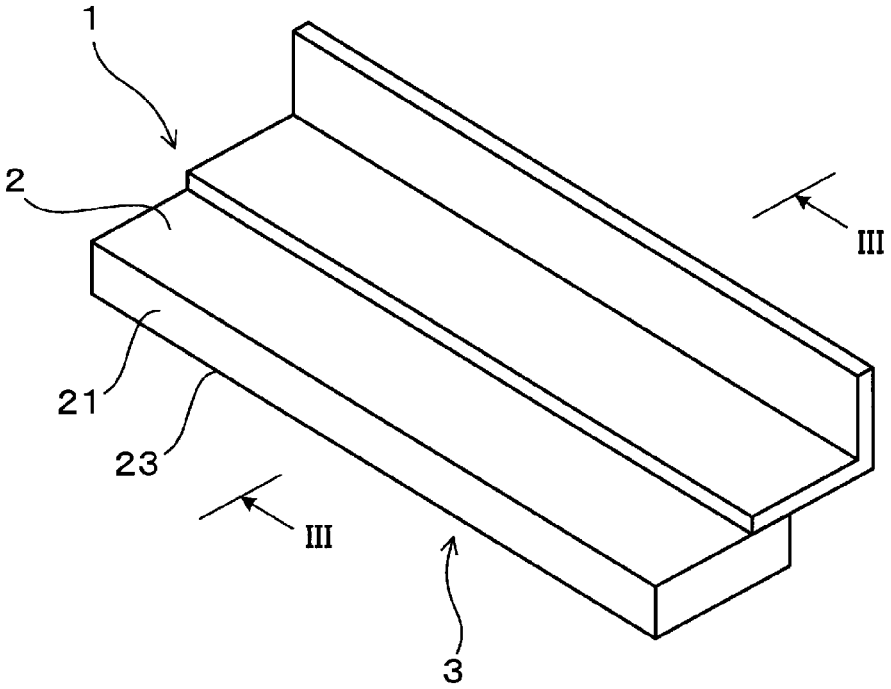
FIG. 2 is a perspective view of a cleaning blade of Example 1.
Figure 3:
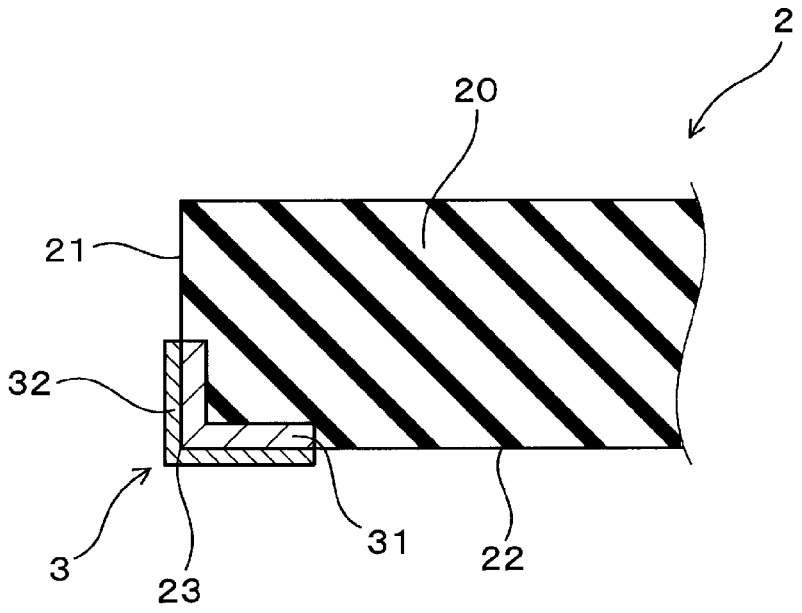
FIG. 3 is a diagram schematically showing an enlarged part of a cross section taken along the line in FIG. 2.

A cleaning blade of Example 1 will be described with reference to FIG. 1 to FIG. 3. As shown in FIG. 1 to FIG. 3, a cleaning blade 1 of the present example is used to remove the remaining toner (not shown, including not only a toner but also a toner external additive) that remains on a surface of a target member 9 in an electrophotographic apparatus. In the present example, specifically, the target member 9 is a photosensitive drum. Here, the photosensitive drum rotates in a direction of an arrow Y shown in FIG. 1.

The cleaning blade 1 includes a blade portion 2 having an edge portion 3 that comes into sliding contact with the target member 9. In the present example, specifically, the substrate of the blade portion 2 is a polyurethane rubber. The polyurethane rubber is non-foamed. In addition, in the drawings, an example in which the blade portion 2 has a plate-like shape is shown. In the present example, specifically, the cleaning blade 1 further includes a support 4 that has a plate-like part 41 and a mounting part 42 that is integrally connected to the plate-like part 41. The blade portion 2 is adhered to one plate surface of the plate-like part 41 in the support 4. Here, although not shown, in the cleaning blade 1, a tip part of the plate-like part 41 in the support 4 may be embedded inside the blade portion 2.

As shown in FIG. 3, the edge portion 3 includes a substrate 20 of the blade portion 2, an inner layer 31 that extends from a surface of the substrate 20 to the inside of the substrate 20, and an outer layer 32 that extends from a surface of the substrate 20 to the outside of the substrate 20.

The inner layer 31 contains at least one of an acrylic resin and a methacrylic resin and has a thickness of less than 1 μm. In addition, the outer layer 32 contains at least one of an acrylic resin and a methacrylic resin and has a thickness of 0.02 μm or less.

In the present example, the edge portion 3 includes a ridge line 23 being an intersection between a first blade surface 21 and a second blade surface 22. Here, both the first blade surface 21 and the second blade surface 22 are disposed so that they face the target member 9 during use. In addition, specifically, the inner layer 31 and the outer layer 32 described above are present at least in a range of 50 μm from the ridge line 23.

Example 2

Figure 4:
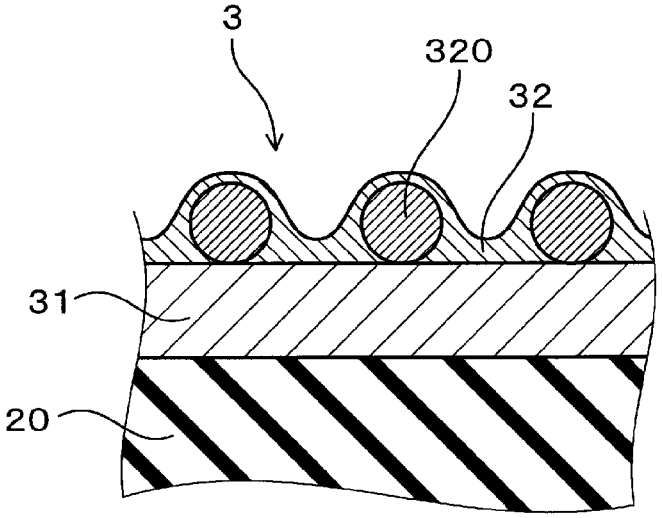
FIG. 4 is a diagram schematically showing an enlarged part of a cross section of an edge portion in a cleaning blade of Example 2.

A cleaning blade of Example 2 will be described with reference to FIG. 4. As shown in FIG. 4, in the cleaning blade 1 of the present example, the outer layer 32 includes a plurality of particles 320 larger than the thickness of the outer layer 32. Therefore, a plurality of protrusions due to the particles 320 retained by the outer layer 32 are formed on a surface of the outer layer 32. In the present example, the particle size of the particles 320 is specifically 10 nm or more and 300 nm or less. The other configurations are the same as those in Example 1.

Experimental examples will be described below in detail.

Experimental Example 1

<Preparation of Urethane Rubber Composition>

44 parts by mass of a vacuum defoamed polybutylene adipate (PBA) ("Nippollan 4010" commercially available from Tosoh Corporation) and 56 parts by mass of 4,4'-diphenylmethane diisocyanate (MDI) ("MILLIONATE MT" commercially available from Tosoh Corporation) were mixed at 80° C. for 1 hour and reacted under a nitrogen atmosphere at 80° C. for 3 hours to prepare a main agent solution containing a urethane prepolymer. Here, NCO % (mass %) in the main agent solution was 17.0%.

In addition, 87 parts by mass of a polybutylene adipate (PBA) ("Nippollan 4010" commercially available from Tosoh Corporation), 13 parts by mass of a low molecular weight polyol obtained by mixing 1,4-butanediol (commercially available from Mitsubishi Chemical Corporation) and trimethylolpropane (commercially available from Koei Chemical Company, Limited) at a weight ratio 6:4, and 0.01 parts by mass of triethylenediamine (commercially available from Tosoh Corporation) as a catalyst were mixed under a nitrogen atmosphere at 80° C. for 1 hour to prepare a curing agent solution with a hydroxyl value (OHV) of 210 (KOH mg/g).

Next, the prepared main agent solution and curing agent solution were mixed at a mixing proportion of 94 parts by mass of the curing agent solution with respect to 100 parts by mass of the main agent solution under a vacuum atmosphere at 60° C. for 3 minutes and sufficiently defoamed. Thereby, a urethane rubber composition was prepared.

<Preparation of Surface Treatment Solution>

100 parts by mass of a pentaerythritol triacrylate ("Aronix M305" commercially available from Toagosei Co., Ltd.) as an acrylic monomer, 5 parts by mass of 2-hydroxy-2-methyl-1-phenyl-propan-1-one ("IRGACURE 1173" commercially available from BASF) as a radical photopolymerization initiator, and 420 parts by mass of methyl ethyl ketone were mixed to prepare a surface treatment solution I-1.

In addition, a surface treatment solution I-2 was prepared in the same manner as in the surface treatment solution I-1 except that 945 parts by mass of methyl ethyl ketone was used.

In addition, a surface treatment solution I-4 was prepared in the same manner as in the surface treatment solution I-1 except that 157.5 parts by mass of methyl ethyl ketone was used.

In addition, a surface treatment solution I-5 was prepared in the same manner as in the surface treatment solution I-1 except that 5145 parts by mass of methyl ethyl ketone was used.

In addition, 100 parts by mass of a pentaerythritol triacrylate ("Aronix M305" commercially available from Toagosei Co., Ltd.) as an acrylic monomer, 5 parts by mass of 2-hydroxy-2-methyl-1-phenyl-propan-1-one ("IRGACURE 1173" commercially available from BASF) as a radical photopolymerization initiator, 5 parts by mass of particles ("QSG-30" commercially available from Shin-Etsu Chemical Co., Ltd., material: silica, particle size: 30 nm), and 420 parts by mass of methyl ethyl ketone were mixed to prepare a surface treatment solution II.

In addition, a surface treatment solution III was prepared in the same manner as in the surface treatment solution II except that particles ("QCB-100" commercially available from Shin-Etsu Chemical Co., Ltd., material: silica, particle size: 200 nm) were used.

<Production of Cleaning Blades of Sample 1 to Sample 3, Sample 1C, and Sample 2C>

A mold including an upper mold and a lower mold was prepared. When the mold was clamped by bringing the upper mold into contact with the lower mold, a cavity having a size corresponding to substantially two long plate-like blade portions was formed therein. Two accommodation units that faced each other were provided in the cavity. In these accommodation units, plate-like parts of a support made of a metal including a long plate component (plate thickness 2 mm) made of a metal and formed by being folded and bent into an L-shaped cross section were disposed.

Next, an epoxy adhesive ("Aron Mighty AS-60" commercially available from Toagosei Co., Ltd.) was applied to one plate surface of the plate-like part in the support.

Next, a support to which an adhesive was applied was set in the accommodation units of the mold and the mold was clamped. Then, a predetermined urethane rubber composition was injected into the cavity and heated at 130° C. for 10 minutes to cure the urethane rubber composition. Then, a molded article was removed from the mold and cut into two parts such that they had a predetermined size. Therefore, as shown in FIG. 2, a plate-like blade portion (thickness 2 mm) using a polyurethane rubber as a substrate was formed on one plate surface of the plate-like part in the support. Here, an adhesive width between the blade portion and the support was 2 mm.

Next, the ridge line of the blade portion was made to face liquid surfaces of the predetermined surface treatment solutions I-1 to I-4 shown in Table 1 to be described below and the blade portion was immersed in the surface treatment solution from a ridge line part. Here, an immersion time of the surface treatment solution was set as shown in Table 1 to be described below. Then, the blade portion was removed from the surface treatment solution, without wiping off the surface treatment solution, ultraviolet rays were emitted using a UV irradiation device ("UB031-2A/BM" commercially available from Eye Graphics Co., Ltd.) under irradiation conditions of a distance of 200 mm between a UV lamp (mercury lamp type) of the UV irradiation device and a ridge line of the blade portion, a UV intensity of 100 mW/cm$^2$ and an irradiation time of 30 seconds, and thereby the surface treatment solution was cured. Therefore, on the edge portion of the blade portion, an inner layer made of an acrylic resin and a polyurethane rubber of a substrate was formed and an outer layer made of an acrylic resin was formed. Thereby, the cleaning blades of the sample 1 to the sample 3, the sample 1C, and the sample 2C were obtained. Here, as shown in Table 1 to be described below, the thickness of the inner layer and the thickness of the outer layer were adjusted by changing a type of the surface treatment solution, a solid content of the surface treatment solution, and an immersion time in the surface treatment solution. In addition, the thickness of the inner layer and the thickness of the outer layer in Table 1 were measured according to the above measurement method. Here, in this measurement, a cross section of the blade portion was dyed with the above 10% phosphotungstic acid aqueous solution.

<Production of Cleaning Blade of Sample 5>

In production of the cleaning blade of the sample 1, after immersion in the surface treatment solution I-1, the surface treatment solution I-1 adhered to the surface of the substrate of the edge portion was wiped off, which was then additionally immersed in the surface treatment solution I-5. Thus, a cleaning blade of the sample 5 was produced in the same manner as in production of the cleaning blade of the sample 1.

<Production of Cleaning Blades of Sample 6 and Sample 7>

A cleaning blade of the sample 6 was produced in the same manner as in production of the cleaning blade of the sample 1 using the surface treatment solution II in place of the surface treatment solution I. In addition, a cleaning blade of the sample 7 was produced in the same manner as in production of the cleaning blade of the sample 1 using the surface treatment solution III in place of the surface treatment solution I. Here, in the cleaning blades of the sample 6 and the sample 7, a predetermined plurality of particles larger than the thickness of the outer layer were retained on the outer layer, and a plurality of protrusions due to the particles were formed on the surface of the outer layer. In addition, the particle size of the particles was measured by the above measurement method.

<Production of Cleaning Blade of Sample 3C>

In production of the cleaning blade of the sample 1, after immersion in the surface treatment solution, the surface treatment solution adhered to the surface of the substrate of the edge portion was wiped off. Thus, a cleaning blade of the sample 3C was produced in the same manner as in production of the cleaning blade of the sample 1.

<Production of Cleaning Blade of Sample 4C>

A blade portion which was not immersed in the surface treatment solution at all, and on which UV irradiation was not performed was prepared as a cleaning blade of the sample 4C.

<Dynamic Friction Coefficient of Edge Portion>

Using a static and dynamic friction coefficient measurement device ("Triboster 500" commercially available from Kyowa Interface Science Co., LTD.), a vertical load of W=100 g was applied to the edge portion of the blade portion fixed on a stage by a contactor, and the stage was moved 1 cm in the horizontal direction at a speed of 7.5 mm/sec. A dynamic friction coefficient (F/W) of the surface of the edge portion was measured from a frictional force F generated between the blade and the contactor at that time. Here, it can be understood that, when the value of the dynamic friction coefficient of the surface of the edge portion is smaller, warping of the blade portion was likely to be prevented for a longer time.

<Anti-Warping Property>

Without applying a lubricant to the blade portion in the cleaning blade of each sample, the edge portion of the blade portion was assembled to be in sliding contact with a photosensitive drum of a digital copying machine ("Imagio MPC4000" commercially available from Ricoh). Then, under an environment of 32.5%×85% RH, 20,000 sheets were printed using A4 size paper. In this case, when no warping of the blade portion occurred, this was determined as "A" because there was an anti-warping property. In addition, when warping of the blade portion occurred, this was determined as "C" because there was no anti-warping property.

<Cleaning Performance>

The edge portions of the cleaning blades of the samples were assembled to be in sliding contact with a photosensitive drum of a digital copying machine ("Imagio MPC4000" commercially available from Ricoh). Then, under an environment of 23° C.×55% RH, 100,000 sheets were printed using A4 size paper. After the duration of this, the cleaning blades of the samples were removed and whether chipping of the edge portion had occurred was examined. In addition, after the duration this, a commercially available tape ("No. 300" commercially available from Okamoto Industries, Inc.) was attached to surface of a charging roll of the digital copying machine and the tape was then peeled off. Then, an area proportion of a toner contamination part with respect to an area in which the tape was attached was obtained.

When there was no chipping of the edge portion and a toner contamination was 20% or less, this was determined as "A" because deterioration in cleaning performance due to chipping of the edge portion and deterioration in cleaning performance due to deterioration in shape conformability with respect to the photosensitive drum were both prevented. When there was chipping of the edge portion and a toner contamination exceeded 20%, this was determined as "C" because cleaning performance had deteriorated due to chipping of the edge portion. In addition, when there was no chipping of the edge portion but a toner contamination exceeded 20%, this was determined as "C" because cleaning performance had deteriorated due to deterioration in shape conformability with respect to the photosensitive drum. The reason why toner contamination of the charging roll rather than the photosensitive drum was evaluated, was that, if slipping through of the toner occurred on the blade portion of the cleaning blade, that part of the photosensitive drum came in contact with the charging roll next and the surface of the charging roll became contaminated.

The configurations, and evaluation results for the anti-warping property and cleaning performance of the cleaning blades of the samples are summarized in Table 1.

TABLE 1

| | Sample 1 | Sample 2 | Sample 3 | Sample 5 | | Sample 6 | Sample 7 | Sample 1C | Sample 2C | Sample 3C | Sample 4C |
|---|---|---|---|---|---|---|---|---|---|---|---|
| Surface treatment solution | | | | | | | | | | | |
| Type | I-1 | I-1 | I-2 | I-1 | I-5 | II | III | I-1 | I-4 | I-1 | — |
| Solid content (%) | 20 | 20 | 10 | 20 | 2 | 20 | 20 | 20 | 40 | 20 | — |
| Immersion time (sec) | 20 | 30 | 20 | 20 | 10 | 20 | 20 | 60 | 5 | 20 | — |
| Edge portion | | | | | | | | | | | |
| Thickness of inner layer (μm) | 0.2 | 0.8 | 0.02 | 0.2 | | 0.2 | 0.2 | 2 | 0.2 | 0.2 | — |
| Thickness of outer layer (μm) | 0.02 | 0.02 | 0.02 | 0.005 | | 0.02 | 0.02 | 0.02 | 0.2 | — | — |
| Particle size of particles in outer layer (nm) | — | — | — | — | | 30 | 200 | — | — | — | — |
| Dynamic friction coefficient | 0.7 | 0.6 | 0.9 | 0.9 | | 0.4 | 0.3 | 0.6 | 0.5 | 1.8 | 4.1 |
| Anti-warping property | A | A | A | A | | A | A | A | A | C | C |
| Cleaning performance | A | A | A | A | | A | A | C | C | — | — |

According to Table 1, the following can be understood. That is, in the cleaning blade of the sample 1C, the edge portion had an inner layer including an acrylic resin and a substrate. However, the thickness of the inner layer exceeded 1 μm. Therefore, in the cleaning blade of the sample 1C, the edge portion became too hard due to the thick inner layer and chipping of the edge portion occurred with regard to durability. The result was that, in the cleaning blade of the sample 1C, cleaning performance had deteriorated due to chipping of the edge portion.

In the cleaning blade of the sample 2C, the edge portion had an outer layer including an acrylic resin. However, the thickness of the outer layer exceeded 0.02 μm. Therefore, in the cleaning blade of the sample 2C, rubber elasticity of the blade portion decreased due to the thick outer layer and shape conformability with respect to the photosensitive drum deteriorated. The result was that, in the cleaning blade of the sample 2C, cleaning performance had deteriorated due to deterioration in shape conformability with respect to the photosensitive drum.

In the cleaning blades of the sample 3C and the sample 4C, the edge portion had no outer layer. Thus, in the cleaning blades of the sample 3C and the sample 4C, friction of the surface of the edge portion was not lowered due to the outer layer and it was not possible to prevent warping of the blade portion. Here, in the cleaning blades of the sample 3C and the sample 4C, since warping of the blade portion occurred, evaluation of the cleaning performance according to the duration was not performed.

On the other hand, in the cleaning blades of the sample 1 to the sample 7, the inner layer of the edge portion contained an acrylic resin and the thickness was less than 1 μm. Therefore, in the cleaning blades of the sample 1 to the sample 7, the edge portion was not excessively hardened due to the inner layer, and it was difficult for chipping of the edge portion with regard to durability to occur. Therefore, in the cleaning blades of the sample 1 to the sample 7, it was possible to prevent deterioration in cleaning performance due to chipping of the edge portion.

In addition, in the cleaning blades of the sample 1 to the sample 7, the outer layer of the edge portion contained an acrylic resin and the thickness was 0.02 μm or less. Therefore, in the cleaning blades of the sample 1 to the sample 7, rubber elasticity of the blade portion according to the outer layer was not decreased and it was possible to maintain shape conformability with respect to the photosensitive drum which was a target member. Therefore, in the cleaning blades of the sample 1 to the sample 7, it was possible to prevent deterioration in cleaning performance due to deterioration in shape conformability with respect to the target member. In addition, in the cleaning blades of the sample 1 to the sample 7, since friction of the surface of the edge portion was lowered due to the outer layer of the edge portion, it was possible to prevent warping of the blade portion.

In addition, when comparing the cleaning blades of the sample 1 to the sample 7, the following can be understood. That is, in the cleaning blades of the sample 6 and the sample 7, the outer layer included a plurality of particles larger than the thickness of the outer layer. Therefore, in the cleaning blades of the sample 6 and the sample 7, protrusions due to the particles formed on the surface of the outer layer came in point contact with the target member. Therefore, in the cleaning blades of the sample 6 and the sample 7, a dynamic friction coefficient of the edge portion was smaller than those of the cleaning blades of the sample 1 to the sample 5. According to these results, it can be understood that, in the cleaning blades of the sample 6 and the sample 7, warping of the blade portion was likely to be prevented for a longer time compared to the cleaning blades of the sample 1 to the sample 5.

Here, while experiments were performed in a case in which the inner layer and the outer layer contained an acrylic resin in the present examples, it can be easily understood from the above results that the same operations and effects would be obtained also in a case in which the inner layer and the outer layer contained a methacrylic resin.

Experimental Example 2

<Production of Cleaning Blades of Sample 8 to Sample 12, and Sample 5C to Sample 9C>

In the same manner as in Experimental Example 1, the cleaning blades of the sample 8 to the sample 12, and the sample 5C to the sample 9C including respective edge portions of the configurations shown in Table 2 were produced. Here, in the present example, the surface treatment solution I-1 was used as the surface treatment solution.

<Measurement of JIS-A Hardness>

The JIS-A hardness of the edge portions of the cleaning blades was measured.

The configurations of the cleaning blades of the samples and the JIS-A hardnesses are summarized in Table 2.

TABLE 2

| | Sample 8 | Sample 9 | Sample 10 | Sample 11 | Sample 12 | Sample 4C | Sample 5C | Sample 6C | Sample 7C | Sample 8C | Sample 9C |
|---|---|---|---|---|---|---|---|---|---|---|---|
| Edge portion | | | | | | | | | | | |
| Thickness of inner layer (μm) | 0.22 | 0.18 | 0.26 | 0.21 | 0.17 | — | 170 | 190 | 240 | 200 | 220 |
| Thickness of outer layer (μm) | 0.02 | 0.02 | 0.02 | 0.02 | 0.02 | — | 0.2 | 0.2 | 0.2 | 0.2 | 0.2 |
| JIS-A hardness (degree) | 70 | 70 | 70 | 71 | 70 | 70 | 79 | 80 | 86 | 82 | 85 |

According to Table 2, the following can be understood. That is, in the cleaning blades of the sample 5C to the sample 9C, the thickness of the inner layer in the edge portion was a thickness of about several hundreds of μm. In addition, the thickness of the outer layer in the edge portion exceeded 0.02 μm. Therefore, in the cleaning blades of the sample 5C to the sample 9C, the JIS-A hardness was higher than that of the cleaning blade of the sample 4C including a blade portion having an edge portion in which the inner layer and the outer layer were not formed. The result was that, in the cleaning blades of the sample 5C to the sample 9C, variation in surface hardness of the edge portion was larger than change in hardness of the edge portion and there was no hardness stability. Therefore, in a configuration of the cleaning blade of the sample 5C to the sample 9C, a difference in cleaning performance occurred due to variation in surface hardness of the edge portion, and it was difficult to stably produce cleaning blades having the same cleaning performance.

On the other hand, it was confirmed that, in the cleaning blades of the sample 8 to the sample 12, since the inner layer and the outer layer were extremely thin, change in hardness of the edge portion was unlikely to occur, it was possible to reduce variation in surface hardness of the edge portion, and hardness stability was excellent. According to these results, it can be understood that, according to the edge portion having the above configuration, a difference in cleaning performance due to variation in surface hardness was smaller, and it was easy to stably produce cleaning blades having the same cleaning performance.

A cleaning blade used to remove the remaining toner that remains on a surface of a target member in an electrophotographic apparatus is provided. The cleaning blade including a blade portion having an edge portion that comes into sliding contact with the target member. The edge portion includes a substrate of the blade portion, an inner layer that extends from a surface of the substrate to an inside of the substrate, and an outer layer that extends from the surface of the substrate to an outside of the substrate. The inner layer contains at least one of an acrylic resin and a methacrylic resin and has a thickness of less than 1 μm. The outer layer contains at least one of an acrylic resin and a methacrylic resin and has a thickness of 0.02 μm or less.

In the cleaning blade, the inner layer of the edge portion contains at least one of an acrylic resin and a methacrylic resin and has a thickness of less than 1 μm. Therefore, in the cleaning blade, the edge portion is not excessively hard due to the inner layer, and it is difficult for chipping of the edge portion with regard to durability to occur. Therefore, the cleaning blade can prevent deterioration in cleaning performance due to chipping of the edge portion.

In addition, in the cleaning blade, the outer layer of the edge portion contains at least one of an acrylic resin and a methacrylic resin and has a thickness of 0.02 μm or less. Therefore, in the cleaning blade, rubber elasticity of the blade portion is not decreased due to the outer layer and it is possible to maintain shape conformability with respect to the target member. Therefore, the cleaning blade can prevent deterioration in cleaning performance due to deterioration in shape conformability with respect to the target member. In addition, in the cleaning blade, since friction of the surface of the edge portion is lowered due to the outer layer of the edge portion, it is possible to prevent warping of the blade portion.

In addition, since the cleaning blade has an edge portion having the above configuration, in the cleaning blade, change in hardness of the edge portion is unlikely to occur, it is possible to reduce variation in surface hardness of the edge portion, and hardness stability is excellent.

While the examples of the disclosure have been described above in detail, the disclosure is not limited to the above examples, and various modifications can be made within a range in which the spirit of the disclosure is not impaired.

What is claimed is:

1. A cleaning blade used to remove the remaining toner that remains on a surface of a target member in an electrophotographic apparatus, the cleaning blade comprising:

a blade portion having an edge portion that comes into sliding contact with the target member, wherein the edge portion comprises a substrate of the blade portion, an inner layer that extends from a surface of the substrate to an inside of the substrate, and an outer layer that extends from a surface of the substrate to an outside of the substrate, the inner layer contains at least one of an acrylic resin and a methacrylic resin and has a thickness of less than 1 μm, and the outer layer contains at least one of an acrylic resin and a methacrylic resin and has a thickness of 0.005 μm or more and 0.02 μm or less.

2. The cleaning blade according to claim 1, wherein the thickness of the inner layer is 0.5 μm or less.

3. The cleaning blade according to claim 2, wherein the thickness of the inner layer is 0.05 μm or more.

4. The cleaning blade according to claim 1, wherein the outer layer comprises a plurality of particles having a particle size larger than the thickness of the outer layer.

5. The cleaning blade according to claim 4, wherein the particle size of the particles is 10 nm or more and 300 nm or less.

6. The cleaning blade according to claim 5, wherein a material of the particles is selected from a group consisting of silica, an acrylic resin, a methacrylic resin, a polyurethane resin, and a polyamide resin.

7. The cleaning blade according to claim 6, wherein the particle size of the particles is 25 nm or more and 200 nm or less.

8. The cleaning blade according to claim 4, wherein a material of the particles is selected from a group consisting of silica, an acrylic resin, a methacrylic resin, a polyurethane resin, and a polyamide resin.

9. The cleaning blade according to claim 4, wherein the particle size of the particles is 25 nm or more and 200 nm or less.

* * * * *